US006499853B2

(12) United States Patent
Stekelenburg

(10) Patent No.: US 6,499,853 B2
(45) Date of Patent: Dec. 31, 2002

(54) NIGHT-LIGHT WITH CHANGEABLE COLOR LIGHT

(75) Inventor: Albert Stekelenburg, Taipei (TW)

(73) Assignee: All-Line Inc., Taipei (TW)

( * ) Notice: Subject to any disclaimer, the term of this patent is extended or adjusted under 35 U.S.C. 154(b) by 2 days.

(21) Appl. No.: 09/901,645

(22) Filed: Jul. 11, 2001

(65) Prior Publication Data

US 2002/0141177 A1 Oct. 3, 2002

(30) Foreign Application Priority Data

Mar. 28, 2001 (TW) ..... 090204691 U

(51) Int. Cl.[7] ..... F21V 9/00

(52) U.S. Cl. ..... 362/84; 362/226; 362/231; 362/280; 362/323; 362/806

(58) Field of Search ..... 362/226, 84, 249, 362/252, 231, 184, 35, 282, 280, 322, 323, 806, 351, 360, 361

(56) References Cited

U.S. PATENT DOCUMENTS 4,344,116 A * 8/1982 Martin ..... 362/226
4,714,984 A * 12/1987 Spector ..... 362/101
5,662,408 A * 9/1997 Marischen ..... 362/226
5,926,440 A * 7/1999 Chien ..... 362/253
6,171,117 B1 * 1/2001 Chien ..... 439/86
6,302,559 B1 * 10/2001 Warren ..... 362/226

FOREIGN PATENT DOCUMENTS

CH 673517 A5 * 7/1983 ..... 362/84
GB 2128313 * 4/1984 ..... 362/84

* cited by examiner

*Primary Examiner*—Thomas M. Sember
(74) *Attorney, Agent, or Firm*—Troxell Law Office PLLC

(57) ABSTRACT

A night-light with changeable color light, having a casing with a nontransparent portion, a transparent portion and a plurality of transparent windows. A luminous part is provided under the casing, having a plurality of light cabinets consisting of electro-luminescence panels with different colors of light. A rotating disc and a power supply plug part are provided under the light cabinets. A power output socket is provided on the upper side of the casing, which casing engages a rotating disc. The luminous portion, power supply plug and the power output socket engage each other, and are stationary. When the casing is rotated, the transparent portions of the casing can be located above a selected light cabinet with the desired color light.

5 Claims, 3 Drawing Sheets

NIGHT-LIGHT WITH CHANGEABLE COLOR LIGHT

FIELD OF THE INVENTION

This invention relates to a structure of a night-light with changeable color light.

BACKGROUND OF THE INVENTION

The conventional night-lights generally have invariable structures, which are typically provided with a small bulb on the inside as a light source and different shapes of covers on the outside. Such lights usually attract customers by different varieties of configurations.

SUMMARY OF THE INVENTION

An object of the present invention is to create a night-light structure, using a variety of electro-luminescence panels for producing different color light, and combining the electro-luminescence panels in light cabinets showing different colors. A luminous part is placed in an arc shape cover with a portion of the cover being transparent. Several transparent windows are installed in the nontransparent portion of the cover. By rotating the cover, the transparent portion of the cover will be located above a light cabinet that emits a certain color light. Since other light chambers are showing different colors of light, the users can select the color they want by rotating the cover.

Another object of the invention is to provide a night-light structure having a socket as a fixing point in which the plug part and the socket are provided in the night-light structure, thus forming a night-light structure with a power output socket.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purpose only.

DETAILED DESCRIPTION OF THE PREFERRED EMBODIMENTS

Figure 1:
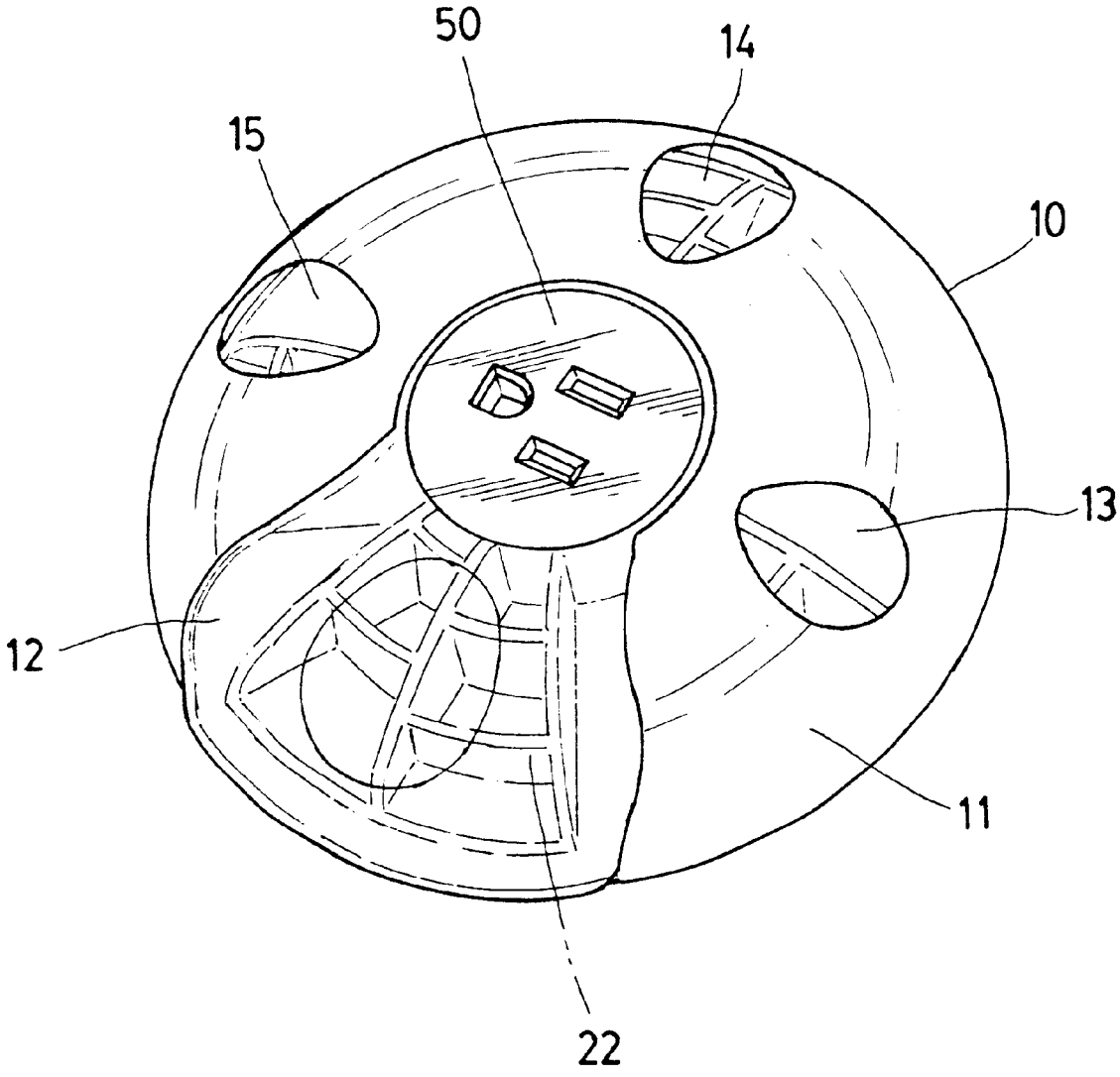
FIG. 1 is a perspective view showing a night-light structure of the present invention.
Figure 2:
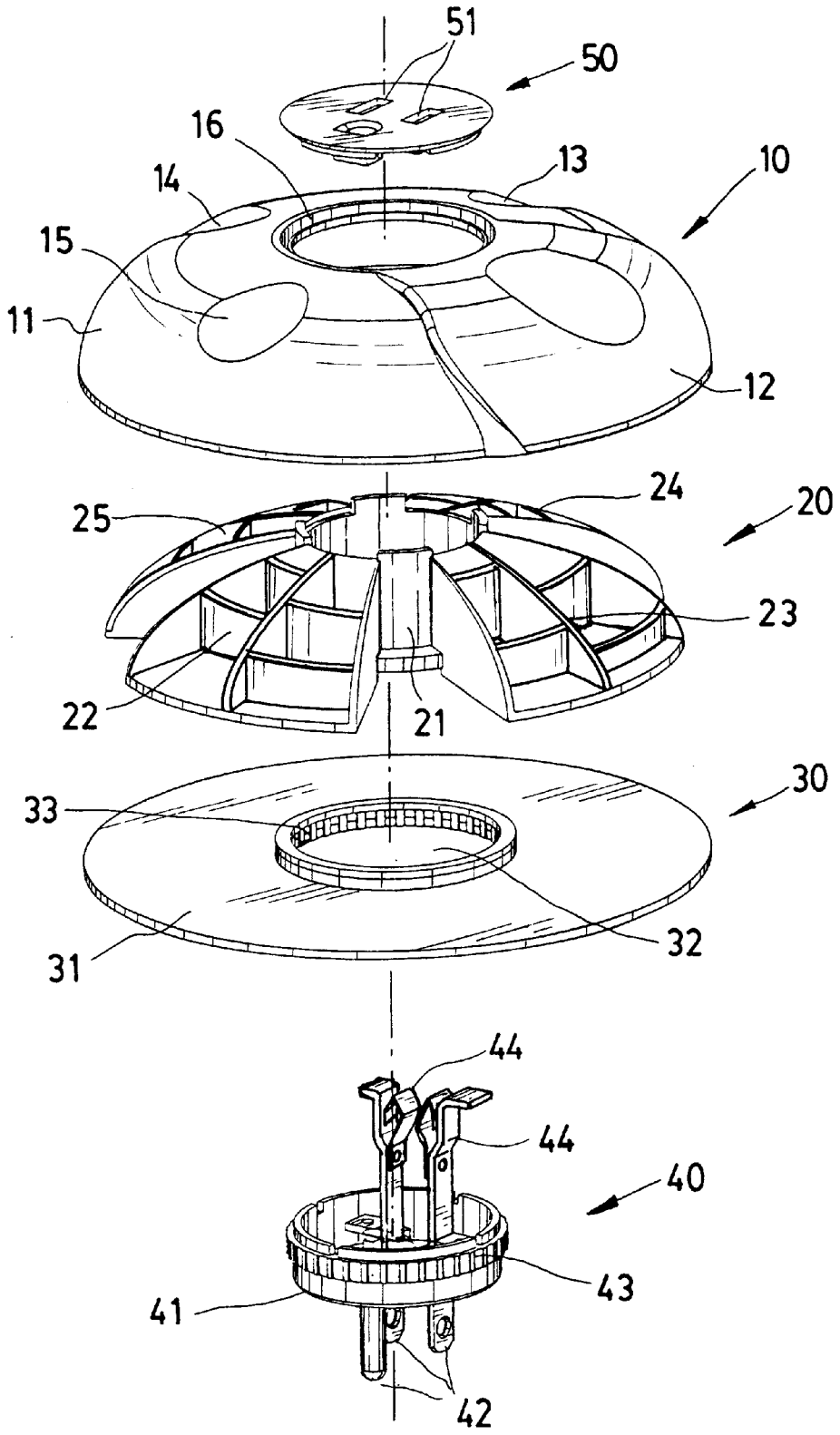
FIG. 2 is an exploded view illustrating a night-light structure of the present invention.

Referring to FIG. 1 and FIG. 2, the structure of the present invention comprises a casing 10, a luminous part 20, a rotating disc 30, a plug part 40 and a socket 50. The casing 10 is a flying disc shaped element, about three quarters of the casing 10 is a nontransparent portion 11 and about one quarter is transparent portion 12. Three transparent windows 13, 14 and 15 are provided in the nontransparent portion 11, and an opening 16 is provided in the center of the casing 10 for receiving the socket 50. The luminous part 20 is placed under the casing 10.

The luminous part 20 comprises a hollow tubular element 21 located in the center and four light cabinets 22, 23, 24 and 25 provided around and extending from the hollow tubular element 21. The upper side of the hollow tubular element 21 engages the socket 50, and the lower side of hollow tubular element 21 engages the plug part 40. Four light cabinets 22, 23, 24 and 25 are provided around the hollow tubular element 21 spaced equally from each other. Light cabinets 22, 23, 24 and 25 comprise electro-luminescence panels which have different color system respectively and emit different colors of cold light automatically.

The rotating disc 30 is a rotatable plate element, which comprises a plate body 31 provided with a center circular opening 32, in which the opening 32 has a cylindrical shape and is provided with protuberances 33 on the inner side. The rotating disc 30 engages, or is adhered to, the casing 10, such that when the casing 10 is rotated, the rotating disc 30 rotates with the casing 10.

Plug part 40 is a socket (indoor or outdoor, etc.), comprising a ring body 41 and several plugs 42. Teeth 43 are provided around the outer surface of the ring body 41. Plugs 42 pass through the body 41 and are provided with spring clamps 44 for transferring the electrical power supplied from plugs 42 to a plug (not shown) inserted into the openings 51 of the socket 50. Thus, socket 50 can be used as a power supply.

The casing 10 engages the rotating disc 30, while the socket 50, the luminous part 20 and the plug part 40 engage each other. Thus, when the plug part 40 is inserted into a general socket such as an indoor socket or the like, so as to be positioned, the socket 50 and the luminous part 20 are fixed. The casing 10 engages the rotating disc 30 such that, when the disc 30 rotates, the protuberances 33 and the teeth 43 are in frictional contact so the user can hear the sound made by the friction or feel the vibration, and thus the casing 10 can be easily positioned.

The transparent part 12 and three transparent windows 13, 14 and 15 of the casing 10 can transmit the cold color light from the light cabinets 22, 23, 24, 25. Therefore, by rotating the casing 10, the transparent portion 12 whose transparent area is the largest can be used as the main color light source, and the casing 10 can be rotated at any time to locate the transparent portion 12 above the light cabinet of the desired color light to change the main light source of the night-light.

The above described night-light with changeable color light has a power supply socket and uses an indoor or outdoor socket as the fixing device, thus it is very practical.

Figure 3:
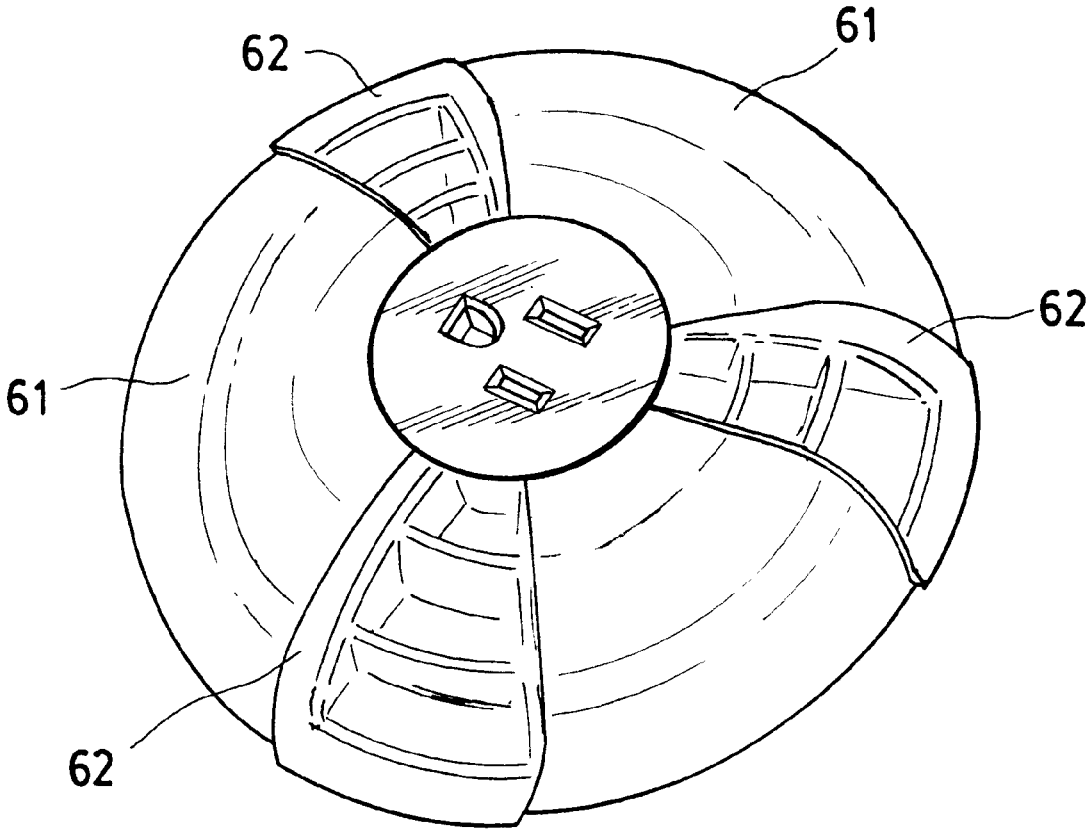
FIG. 3 is a perspective view of another embodiment of the present invention.

The luminous part 20 of the invention can be provided with more than two light cabinets which have different color light, as shown in FIG. 3. A plurality of transparent portions 62 (or transparent pattern) are provided in the casing 61. Thus, the night-light emits more than one color light while rotating the casing 61, and a night-light with changeable color light is formed.

For the above night-light changeable color light, if the plug 41 is nonconductor, is not necessary to provide the socket 50 on the casing 10.

The luminous part 20 of the invention makes use of electro-luminescence panels, and its configuration is not limited to that shown in the above drawings.

The foregoing description is provided for illustrative purposes only and should not be construed as limiting this invention, the scope of which is defined solely by the appended claims.

What is claimed is:

1. A night light with changeable color light comprising:

a) a casing having a convexly curved outer surface with a non-transparent portion, and at least one transparent portion;

b) a luminous assembly having a central hollow tubular element with a plurality of electro-luminescence light emitting cabinets extending outwardly from the central tubular element, the light emitting cabinets emitting different colors of light;

c) a rotatable disc engaged with the casing such that the luminous assembly is located between the rotatable disc and the casing, the rotatable disc having a central opening; and, d) a plug assembly having a body with a plurality of plugs extending therefrom, the plug assembly fixedly engaging the luminous assembly and rotatably engaging the rotatable disc such that the rotatable disc and casing are rotatable relative to the luminous assembly and the plug assembly whereby the at least one transparent portion may be aligned with a light emitting cabinet having a desired light color.

2. The night light of claim 1 wherein the casing comprises a single transparent portion and a plurality of transparent windows.

3. The night light of claim 1 wherein the casing comprises a plurality of transparent portions.

4. The night light of claim 1 further comprising a casing opening extending through the casing and an electrical socket located in the casing opening.

5. The night light of claim 1 wherein the plurality of light emitting cabinets are equidistantly spaced apart around the central hollow tube.

* * * * *